US009350112B2

(12) United States Patent
Arroyo Sosa

(10) Patent No.: US 9,350,112 B2
(45) Date of Patent: May 24, 2016

(54) ELECTRICAL PLUG WITH A CABLE FASTENER

(71) Applicant: Pedro Arroyo Sosa, Kansas City, KS (US)

(72) Inventor: Pedro Arroyo Sosa, Kansas City, KS (US)

( * ) Notice: Subject to any disclaimer, the term of this patent is extended or adjusted under 35 U.S.C. 154(b) by 0 days.

(21) Appl. No.: 14/617,541

(22) Filed: Feb. 9, 2015

(65) Prior Publication Data

US 2015/0236456 A1 Aug. 20, 2015

Related U.S. Application Data

(60) Provisional application No. 61/941,163, filed on Feb. 18, 2014.

(51) Int. Cl.

| | |
|---|---|
| ***H01R 13/04*** | (2006.01) |
| ***H01R 13/58*** | (2006.01) |
| ***H01R 4/50*** | (2006.01) |
| *H01R 103/00* | (2006.01) |
| *H01R 24/30* | (2011.01) |

(52) U.S. Cl.

CPC ..... *H01R 13/5816* (2013.01); *H01R 4/505* (2013.01); *H01R 13/5837* (2013.01); *H01R 24/30* (2013.01); *H01R 2103/00* (2013.01)

(58) Field of Classification Search

CPC ..... H01R 13/5816; H01R 13/5837; H01R 13/505; H01R 2103/00; H01R 2105/00

USPC ..... 439/697, 106, 536, 738, 750, 617, 646, 439/372, 888, 550, 232

See application file for complete search history.

(56) References Cited

U.S. PATENT DOCUMENTS

| | | | | |
|---|---|---|---|---|
| 774,250 | A | 11/1904 | Hubbell | |
| 1,672,067 | A | 6/1928 | Labre | |
| 6,561,848 | B1 * | 5/2003 | Khemakhem | H01R 9/0512 439/550 |
| 7,175,463 | B2 * | 2/2007 | Burton | H01R 4/489 439/346 |
| 7,214,094 | B2 * | 5/2007 | Kaminski | B60D 1/64 439/316 |
| 7,524,217 | B2 * | 4/2009 | Copper | H01R 4/5091 174/94 S |
| 2005/0255738 | A1 * | 11/2005 | Burton | H01R 4/489 439/369 |
| 2007/0026735 | A1 * | 2/2007 | Pyron | B60R 16/0222 439/584 |
| 2007/0160327 | A1 * | 7/2007 | Lewallen | G02B 6/3817 385/53 |
| 2007/0254525 | A1 * | 11/2007 | Pyron | H02G 3/085 439/584 |
| 2012/0238126 | A1 * | 9/2012 | Damodharan | H01R 4/2433 439/395 |

FOREIGN PATENT DOCUMENTS

| | | |
|---|---|---|
| DE | 370538 | 9/1921 |
| GB | 16898 | 0/1896 |

* cited by examiner

*Primary Examiner* — Abdullah Riyami

*Assistant Examiner* — Harshad Patel

(74) *Attorney, Agent, or Firm* — Law Office of Mark Brown, LLC; Christopher M. DeBacker

(57) ABSTRACT

An improved electrical plug uses a wire receiver for connecting to electrical lines. These receivers include a hook received by a cavity, the hook having an arm for moving the hook and pressing the electrical line against an electrical contact A locking and unlocking mechanism secures a plug cover to an electrical contact holder, the cover having a number of passages and slopes for locking and unlocking the cover from the contact holder. A space adjuster mechanism is provided to fasten against a cable containing the electrical lines. A number of concentrically and uniformly arranged petals slide against each other and tighten about the cable, locking it in place.

2 Claims, 6 Drawing Sheets

ELECTRICAL PLUG WITH A CABLE FASTENER

CROSS-REFERENCE TO RELATED APPLICATION

This claims priority in U.S. Provisional Patent Application No. 61/941,163 filed Feb. 18, 2014, which is incorporated herein by reference.

BACKGROUND OF THE INVENTION

1. Field of the Invention

The invention relates to an electrical plug the kind used on electrically operated equipment, particularly to improvements into the components and the way all the components within the plug are attached and secured without the function of screws for this purpose.

2. Description of the Related Art

Electrical plugs including on electrically operated equipment are well known in the art. AC power plugs and sockets are devices that allow electrically operated equipment to be connected to the primary alternating current power supply in a building. Plugs and sockets for portable appliances started becoming available in 1880s'.

Generally the plug is the movable contact attached to an electrically operated device's mains cable, and the socket is fixed on equipment or a building structure and connected to an energized electrical circuit. The plug has protruding prongs, blades, or pins (referred to as male) that fit into matching slots or holes (called female) in the sockets.

As electricity became a common method of operating labour-saving appliances, a safe means of connection to the electricity system other than using a light socket was needed. According to British Author John Mellanby the first plug and socket in England was introduced by T. T. Smith in 1883, and there were two-pin designs by 1885, one of which appears in the General Electric Company Ltd. Gustav Binswanger, a German immigrant who founded the (British) General Electric Company Ltd, obtained a patent (GB189516898) in 1895 for a plug and socket using a concentric (co-axial) contact system.

An early electrical plug and socket was invented by Harvey Hubbelll and patented in 1904. Hubbell's first design was a socket which screwed into a lamp holder (like the early lamp holder plugs), but with a separable plug with pins or blades (U.S. Pat. No. 774,250).

The German Schuko-system plug was patented by Albert Büttner in 1926. The current American version of the earthed plug, with two parallel blades and a round earthing pin, was invented by Philip F. Labre, while he was attending the Milwaukee School of Engineering. He was issued an US patent for an earthed socket and plug in 1928.

In the prior art, the most conventional male and female electrical plugs replacements in use require a metal holder with a hole on its center to be attached to the wires with screws. Although these fixes tend to work, attaching the wires into these holders with the screws is difficult and it takes a considerable amount time depending of the model and design. Further, the most common plugs replacements use screws to keep the cord tightened and to keep the cover secured to the holder of the electrical contact.

BRIEF SUMMARY OF THE INVENTION

The object of this invention is to provide within a plug, improved components eliminating the function of conventional screws. According to the characteristics of the invention, a novelty line attacher is provided to attach each wire to each electrical contact within an electrical plug. A novelty locking and unlocking mechanism is provided to secure a cover to the component holding the electrical contacts within the plug and a space adjuster mechanism is provided to keep a cord cable tightened firmly to the plug.

The wire receiver includes a hook hanging into a line holder's cavity, the said hook having an elongated arm and the cavity of the said line holder matching at least part of the curvature of the hook, wherein the elongated arm transmitting a force to the hook, therefore the hook coupling into the line holder pressing the electrical contact and securing the electrical wire between.

The locking and unlocking mechanism includes a holder with a complex of passages and slopes, wherein a tooth coupled to the component to be attached, passing through a main passage and locking behind a locking slope. The tooth can be unlocked by sliding an edge of the tooth up an unlocking slope to an exit passage.

The space adjuster mechanism includes a concentrical flower consisting of several movable petals being concentrically and uniformly arranged, such that said petals are pivotally coupled to a concentrical guide's slots and pivotally coupled to a motion transmitter's slots. The petals are mounted one over another on their interior sides, which face the central axis. The motion transmitter causes the petals to rotate on their interior sides one over the other, thereby adjusting the space among the interior sides, and pressing the cord cable in between the petals.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

Figure 1:
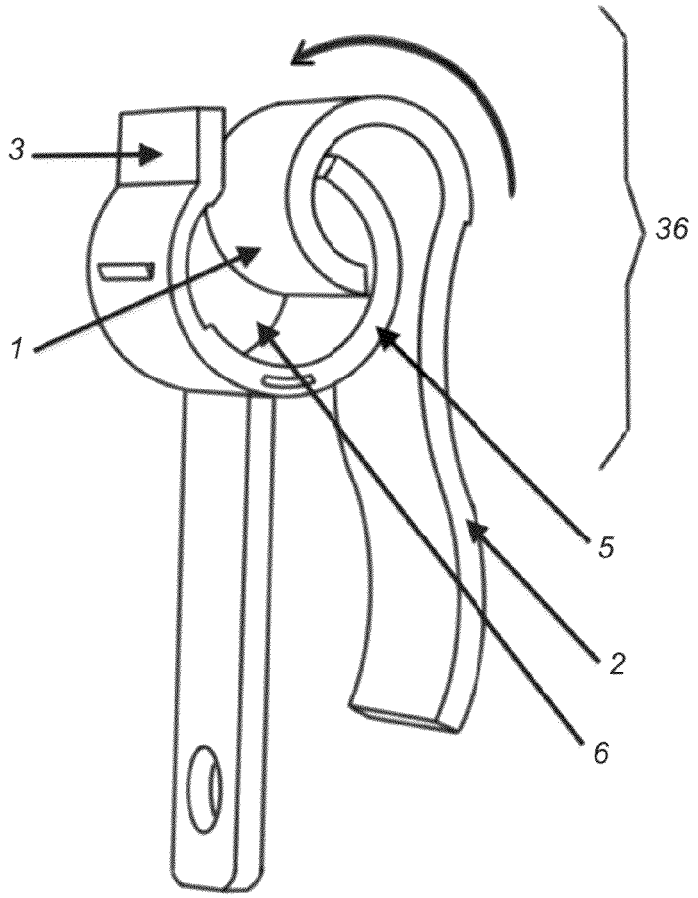
FIG. 1 is an elevational view of the line attacher coupled to the electrical contact.
Figure 7:
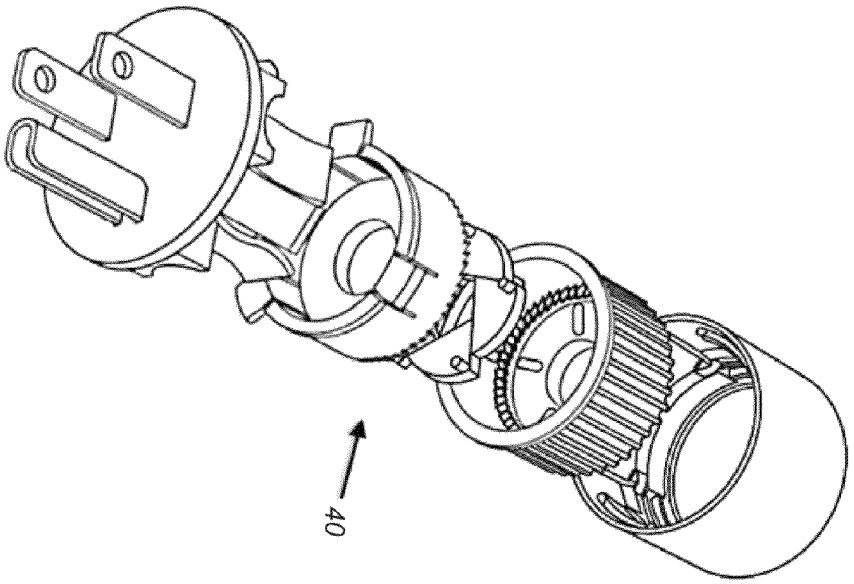
FIG. 7 is an elevational view of the improved electrical plug.

Referring to the drawings, there are provided components for an improved electrical plug 40 illustrated generally in FIG. 7 wherein the plug uses an improved wire receiver 36 illustrated in FIG. 1. A hook 1 hanging into a cavity 6 is attached to an elongated arm which may be pushed or pulled up, thereby moving the hook 1 into the cavity 6 and pressing against the electrical contact 3. A wire can be received between the hook and the electrical contact. The elongation of the line holder 5 shows an alternative modification of the embodiment.

Figure 2:
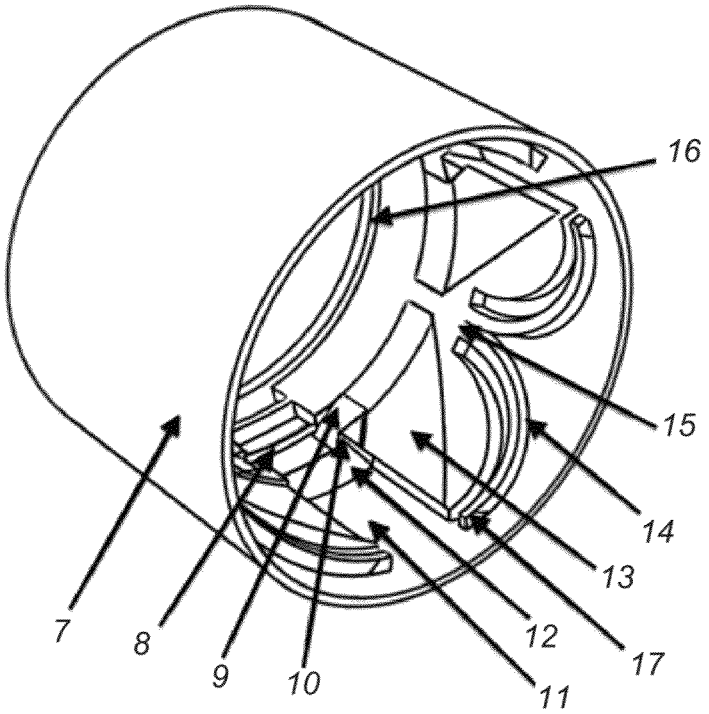
FIG. 2 is an elevational partial view of the locking and unlocking mechanism.
Figure 3:
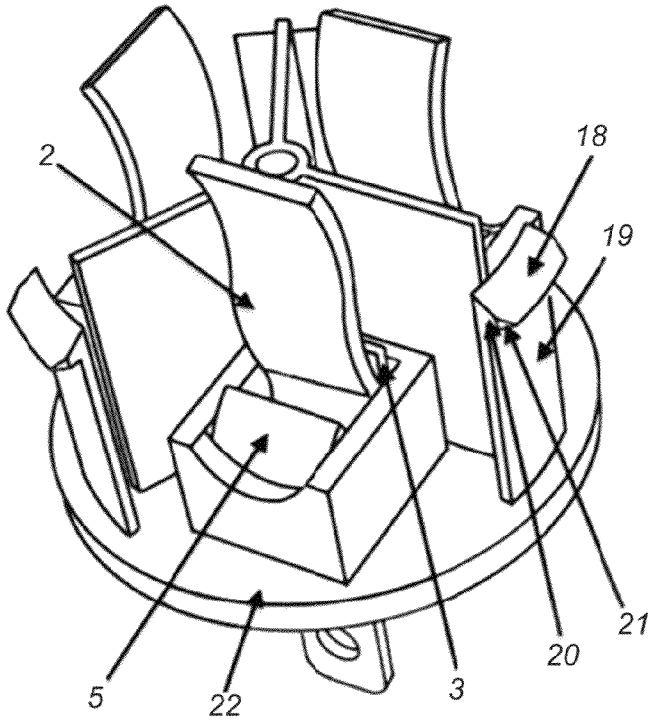
FIG. 3 is an elevational complementary partial view of the locking and unlocking mechanism showing the electrical contact's holder and the features of the tooth.

FIG. 2 and FIG. 3 provide a locking and unlocking mechanism for attaching a plug's cover to an electrical contact holder 22. As illustrated in FIG. 3, an elongated body 19 of a flexible material terminates into a tooth 18 configured to be coupled to the electrical contact's holder 22. The elongated body 19 passes through a main passage 11 illustrated in FIG. 2. The elongated body 19 is guided up a locking slope 12 and the tooth is locked behind the slope 12. Once locked in place, it can be unlocked by turning the holder body 7 in relation to the electric contact holder 22 either left or right, there forcing the tooth 18 to climb an unlocking slope 9 and slide out from behind the locking slop 12 via an exit passage 13. A second locking slope 8 is included behind the locking slope 12, this second locking slope 8 intended to receive a tab 23 of a concentrical guide 36 shown in FIG. 4. A rim 16 is included to prevent a motion transmitter 35 and other optional elements shown fitting together in FIG. 7 from exiting the back end of the holder body 7.

An optional unlocking preventer mechanism is shown in FIG. 2 and FIG. 3 as well, wherein the tooth 18 as illustrated in FIG. 3 has a partially flat portion 20 and angled portion 21. A plurality of elongated springs 14 illustrated FIG. 2 including a first extreme 15 of each elongated spring 14 is connected to the holder body 7 and a second extreme 17 of each elongated spring 14 is pressing against the electrical contact holder 22 thereby resisting against it. A barrier 10 within the holder body 7 prevents the tooth 18 from being unlocked as described above by blocking the flat portion 20 of the tooth 18. Only when the elongated springs 14 are bent by pushing against the electrical contact holder 22 will the flat portion 20 of the tooth 18 pass by the barrier 10 and free the tooth, thereby unlocking the connection by allowing the angled portion 21 of the tooth 18 to slide up the unlocking slope 9.

Figure 4:
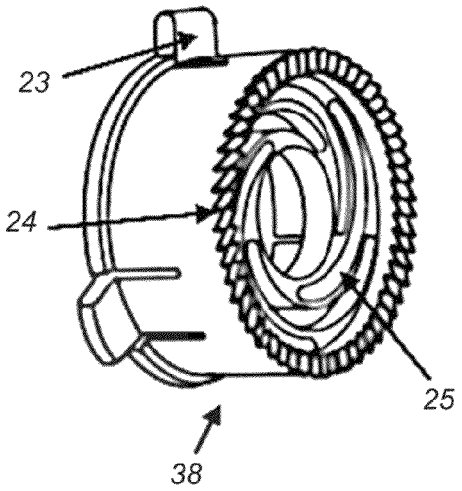
FIG. 4 is an elevational view of the concentrical guide.
Figure 5:
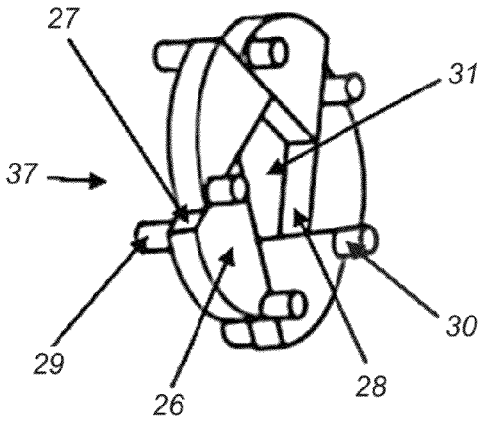
FIG. 5 is an elevational view of the plurality of petals called the concentrical flower.
Figure 6:
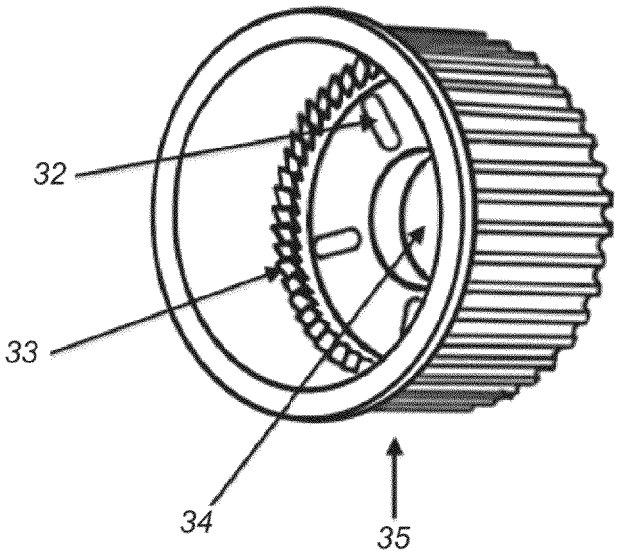
FIG. 6 is an elevational view of the motion transmitter.

FIG. 4, FIG. 5 and FIG. 6 provide a space adjuster mechanism used with the electrical plug 40 as shown in FIG. 7 to fasten a cable containing wires to the plug. A plurality of petals 26 concentrically and uniformly arranged around an opening 31 are arranged such that the petals slide one over another. Each second side 27 of each petal 26 is mounted over a respective first side 28 of the next petal 26. Each petal 26 includes a guide pin 29 coupled into a guide slot 25 within the concentrical guide 38. Each petal 26 further includes a motion pin 30 coupled into a motion slot 32 within the motion transmitter 35. When the motion transmitter 35 rotates, it drives all of the petals 26 simultaneously via the motion slots 32. Similarly, within the concentrical flower 37, the guide pins 29 move a first face of each petal 26 inward toward the cener axis. A second face of each petal 26 is forced to be moved by the motion slot 32 outward away from the center axis, such that each petal 26 slides over its neighboring petal thereby adjusting the hole's size 31. This adjustment is intended to remain in place by the plurality of concentrical teeth 24 of the concentrical guide 38 engaged with the plurality of concentrical teeth 33 of the motion transmitter 35, to tighten up against the cable.

The invention claimed is:

1. An electrical plug for electrically operated devices, the electrical plug comprising:

a wire receiver including a hook having an elongated arm, the hook hanging into a cavity of an electrical contact holder, said cavity corresponding with a curvature of the hook, and a line connector adjacent to the cavity, wherein the elongated arm is configured to rotate the hook thereby causing the hook to be inserted into the cavity pressing against the line connector;

said wire receiver configured to receive a wire between said hook and an electric contact held in said electrical contacts holder;

a plug cover configured to cover said electrical contact;

a cable fastener connected to said electric contacts holder, said cable fastener configured to receive an end of a cable containing said wire; a locking and unlocking mechanism for securing the plug cover to the electrical contact holder; a plurality of passages and slopes within a holder body, said holder body having at least a main passage, a locking slope adjacent to a first end of said main passage; an unlocking slope including an exit passage leading to the main passage located adjacent to said locking slope; an elongated arm having a tooth, said arm configured for passing through the main passage of the holder body, wherein said tooth is configure to engage said locking slope, thereby locking said tooth behind the locking slope adjacent to the unlocking slope; at least one lateral side of said tooth comprises a first, generally flat portion and a second, generally angled portion; a plurality of elongated springs matching the surface of the holder body, wherein a first extreme of each elongated spring is joined to the holder body and a second extreme rejecting the electrical contact holder; and a barrier within the holder body, said barrier adjacent to the locking slope, said barrier blocking the first portion of the lateral side of the tooth.

2. The electrical plug of claim 1, further comprising a space adjuster mechanism within the cable fastener, configured for adjusting the size of a hole around the cable fastener and tightening against cable, wherein the space adjuster mechanism comprises:

a concentrical guide having at least three guide slots concentrically arranged to an axis and a plurality of teeth concentrically arranged to the axis, wherein a first end of each of said guide slots are located near the edge of said concentrical guide away from the axis and a second end of each of said guide slots is located near the center of the concentrical guide toward the axis;

a plurality of petals, said petals being components concentrically and uniformly arranged about the axis, each petal having a first side corresponding to an adjacent second side of the next of said plurality petals, wherein each petal's first side to faces towards the axis; and a motion transmitter, having at least three motion slots and a plurality of concentrical teeth configured to engage the plurality of concentrical teeth of the concentrical guide, each motion slot pivotally coupled to the second face of a respective petal, wherein the motion transmitter is configured to move the petals along the motion slots, the first face of each petal moving toward the axis along the guide slots and the second face of each petal moving outward away from the axis along the motion slots, thereby adjusting the hole formed between the petals.

* * * * *